US007530857B2

(12) United States Patent
Domps

(10) Patent No.: US 7,530,857 B2
(45) Date of Patent: May 12, 2009

(54) CONNECTOR FOR A BATTERY TERMINAL

(75) Inventor: Etienne Domps, La Motte Servolex (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 11/774,631

(22) Filed: Jul. 9, 2007

(65) Prior Publication Data

US 2008/0026643 A1 Jan. 31, 2008

(30) Foreign Application Priority Data

Jul. 28, 2006 (FR) ..... 06 53186

(51) Int. Cl.
*H01R 11/01* (2006.01)

(52) U.S. Cl. ..... 439/754; 439/756; 439/757; 439/759; 439/822; 439/829; 439/761; 439/769; 439/770; 439/772

(58) Field of Classification Search ..... 439/754, 439/756–757, 759, 761, 769–770, 772–773, 439/822, 829
See application file for complete search history.

(56) References Cited

U.S. PATENT DOCUMENTS

| | | | | |
|---|---|---|---|---|
| 2,819,455 | A | 1/1958 | McCray | |
| 4,153,321 | A * | 5/1979 | Pombrol | 439/437 |
| 4,385,796 | A * | 5/1983 | Eriksson | 439/772 |
| 4,470,654 | A * | 9/1984 | Friedman | 439/435 |
| 5,556,309 | A * | 9/1996 | Sharpe et al. | 439/759 |
| 6,238,253 | B1 * | 5/2001 | Qualls | 439/759 |
| 6,287,155 | B1 * | 9/2001 | Yakovich | 439/772 |
| 6,623,315 | B1 * | 9/2003 | Roderick | 439/772 |
| 2004/0161980 | A1 * | 8/2004 | Cret | 439/759 |

FOREIGN PATENT DOCUMENTS

| | | |
|---|---|---|
| EP | 0 896 389 A1 | 2/1999 |
| EP | 1 498 987 A1 | 1/2005 |

* cited by examiner

*Primary Examiner*—Briggitte R Hammond
*Assistant Examiner*—Vanessa Girardi
(74) *Attorney, Agent, or Firm*—Barley Snyder LLC

(57) ABSTRACT

A connector for a terminal of a battery includes an elastically deformable clamping member that receives the terminal of the battery. A lever is moveable relative to the clamping member between a locked position and an unlocked position. The lever applies a clamping force to the clamping member in the unlocked position. A locking element engages the lever in the locked position to prevent movement thereof. The locking element is elastically deformable such that the locking element releases the lever when the clamping member receives the terminal of the battery so that the lever is moveable to the unlocked position.

14 Claims, 5 Drawing Sheets

CONNECTOR FOR A BATTERY TERMINAL

CROSS-REFERENCE TO RELATED APPLICATIONS

This application claims the benefit of the filing date under 35 U.S.C. § 119(a)-(d) of France Patent Application No. 0653186, filed Jul. 28, 2006.

FIELD OF THE INVENTION

The present invention relates to a connector for a battery terminal comprising a clamping lug for clamping the terminal of the battery and a lever for clamping the clamping lug.

BACKGROUND

Connectors are provided which are intended to be connected to either substantially cylindrical or truncated cone-shaped terminals on batteries that store electrical power. Connectors of this type are well known in the art, for example, from U.S. Pat. No. 2,819,455, U.S. Pat. No. 4,385,796, U.S. Pat. No. 5,556,309, and EP 0 896 389.

Improving the secureness of the clamping of the connectors to the terminals of the battery is a key concern for designers. In practice, it has been found that the secureness of the connection to the terminal was dependent upon the correct fitting of the connector to the terminal of the battery before clamping. However, it is up to a user to ensure the correct fitting of the connector to the terminal before the clamping thereof. As a result, incorrect fitting of the connector often occurs and results in poor electrical contact between the connector and the terminal and/or to a possible breakdown of the electrical contact therebetween.

BRIEF SUMMARY

It is therefore an object of the present invention to provide a connector having an improved secured clamping of the connector to a terminal of a battery.

This and other objects are achieved by a connector for a terminal of a battery comprising an elastically deformable clamping member that receives the terminal of the battery. A lever is moveable relative to the clamping member between a locked position and an unlocked position. The lever applies a clamping force to the clamping member in the unlocked position. A locking element engages the lever in the locked position to prevent movement thereof. The locking element is elastically deformable such that the locking element releases the lever when the clamping member receives the terminal of the battery so that the lever is moveable to the unlocked position.

DETAILED DESCRIPTION OF THE EMBODIMENT(S)

Figure 1:
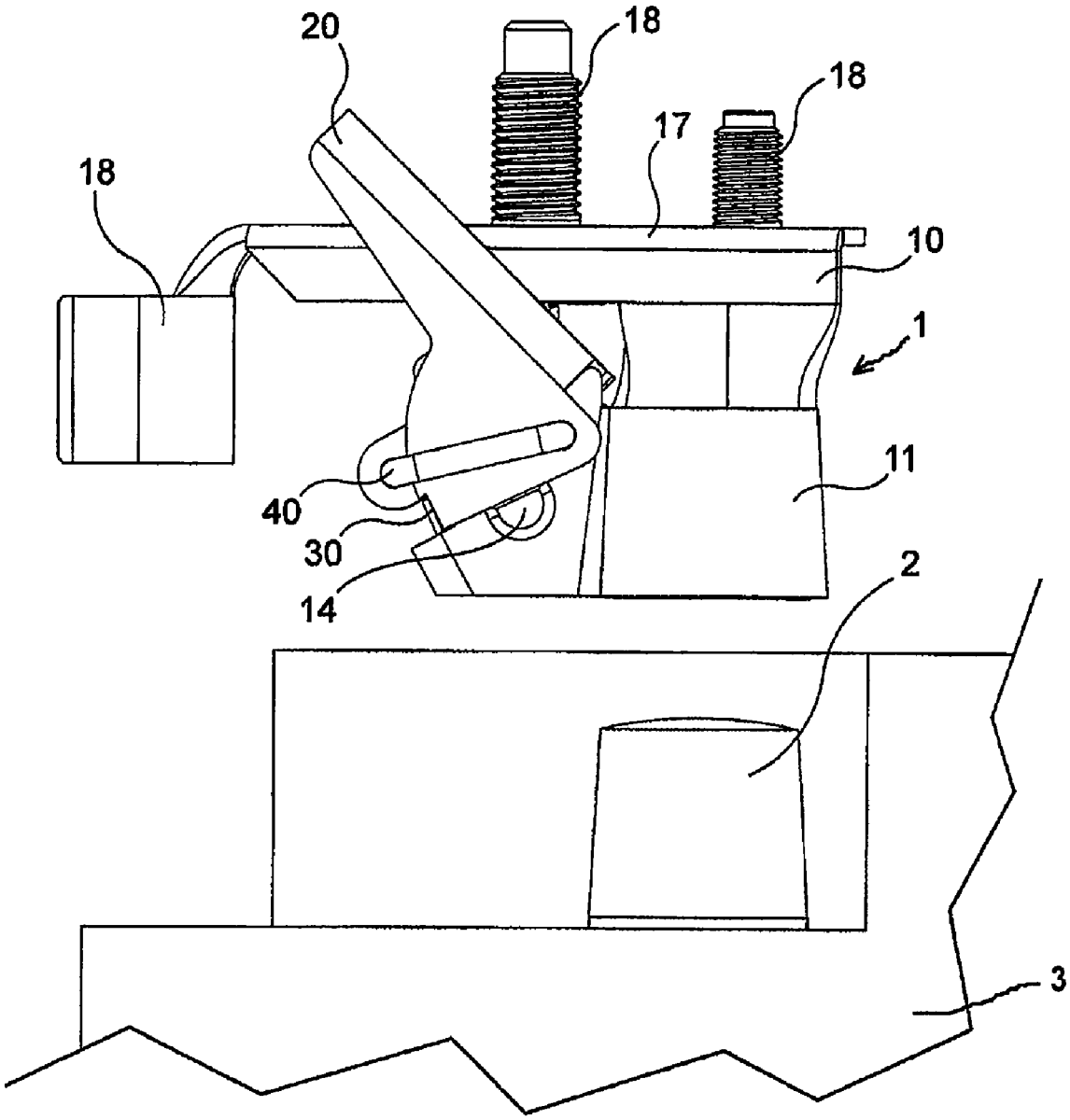
FIG. 1 is a schematic illustration of a connector for a battery terminal according to an embodiment of the invention before being fit to the terminal of the battery.
Figure 2:
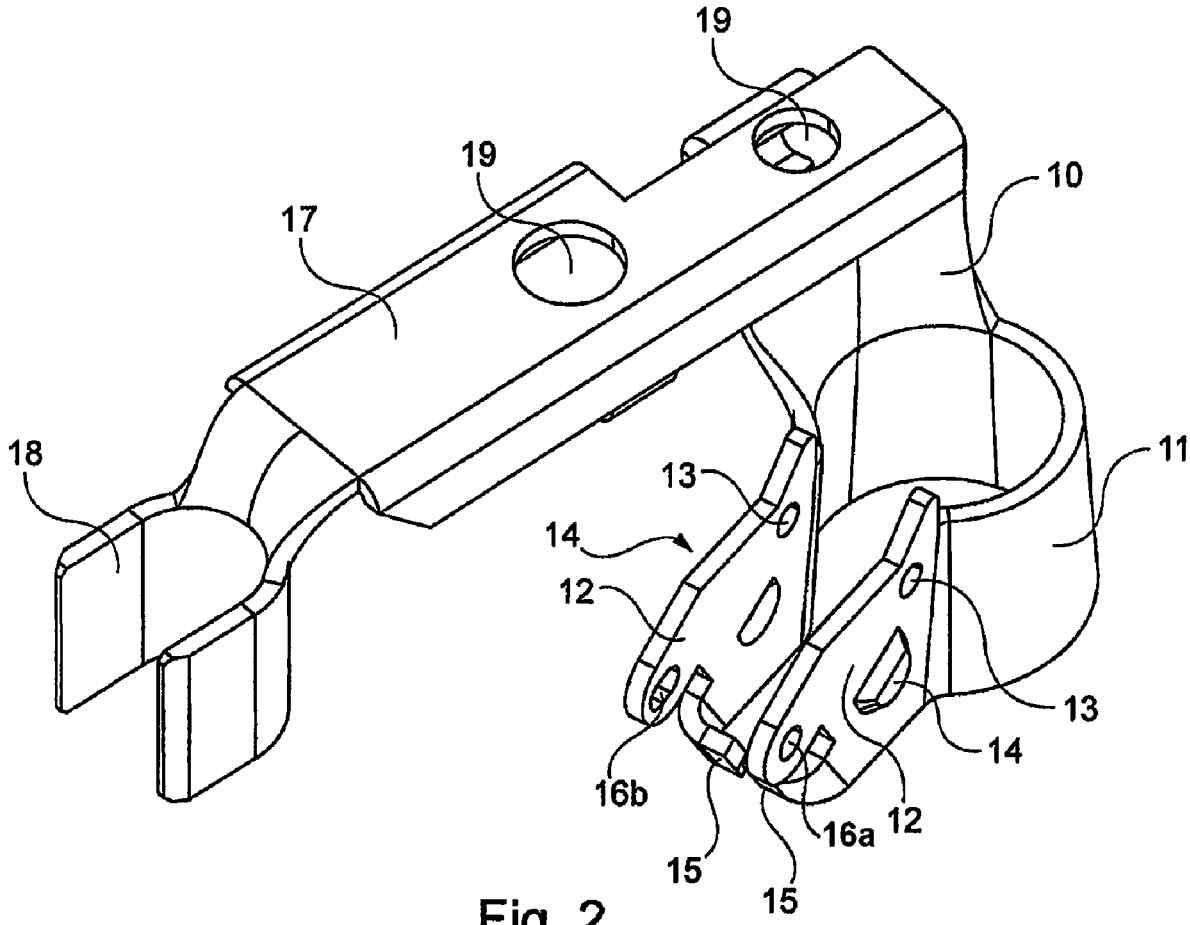
FIG. 2 is a perspective view of a clamping lug of the connector of FIG. 1.

FIG. 1 shows a connector 1 for a battery terminal according to an embodiment of the invention. The connector 1 is configured to be fixed to a terminal 2 of an electric battery 3 and comprises a clamping lug 10, a clamping lever 20, a locking element 30, and a clip 40. As shown in FIG. 2, the clamping lug 10 includes a clamping member 11 and a connection portion 17. The clamping member 11 is configured to clamp the terminal 2 of the battery 3. The clamping member 11 is substantially U-shaped and includes elastically deformable arms 12. The arms 12 are substantially symmetrical and extend substantially parallel to each other. The arms 12 are configured to elastically deform toward each other. The arms 12 of the clamping lug 10 are configured to receive an element for clamping the clamping lug 10, for example, the clamping lever 20, in such a way that the lever 20 can move relative to the clamping lug 10 in order to clamp the clamping lug 10. Each of the arms 12 is provided with a coaxial aperture 13 and an outer surface cam groove 14. Extensions 15 are provided at an end of each of the arms 12. Each of the extensions 15 extends inwardly at a right angle from the respective arm 12. Each of the arms has a coaxial hole 16*a*, 16*b*. The hole 16*b* has a substantially oblong configuration.

As shown in FIGS. 1-2, the connection member 17 includes terminal connection members 18 connected to electrical conductors intended to be electrically connected to the terminal 2 of the battery 3. As shown in FIG. 2, openings 19 are provided in the connection member 17 and are configured to fix at least a few of the terminal connection members 18. The clamping lug 10 may be formed, for example, from a stamped and formed metal sheet.

Figure 3:
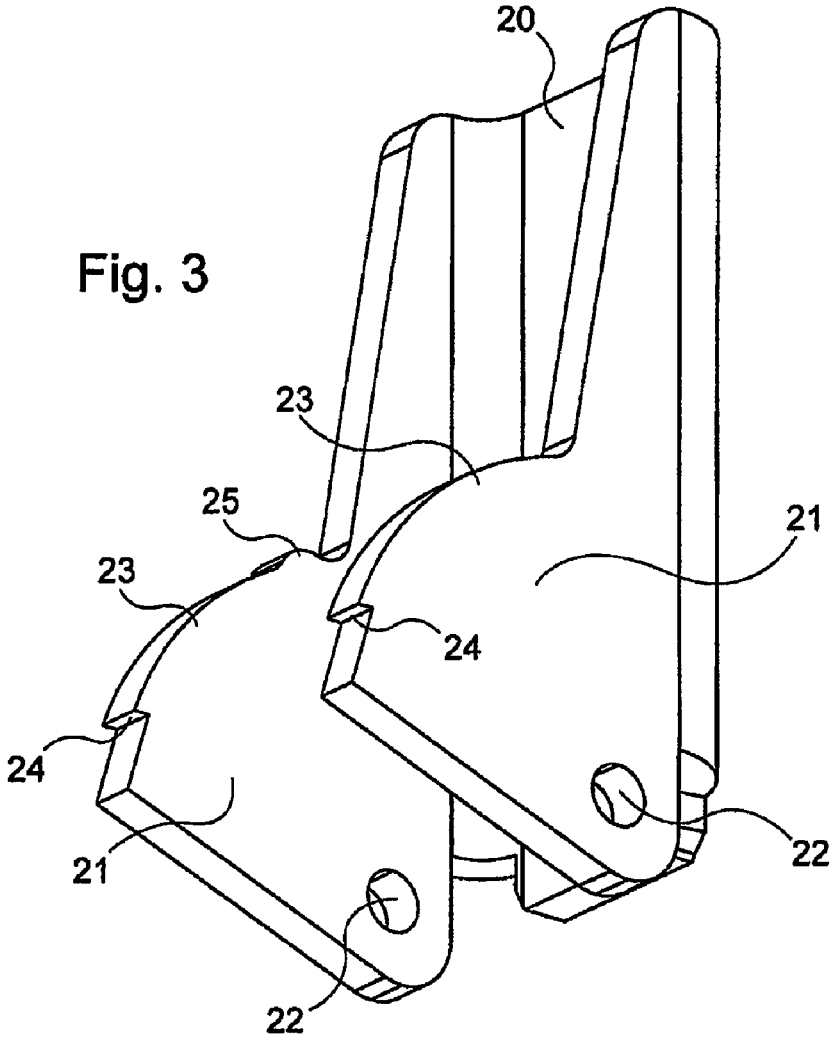
FIG. 3 is a perspective view of a clamping lever of the connector of FIG. 1.
Figure 4:
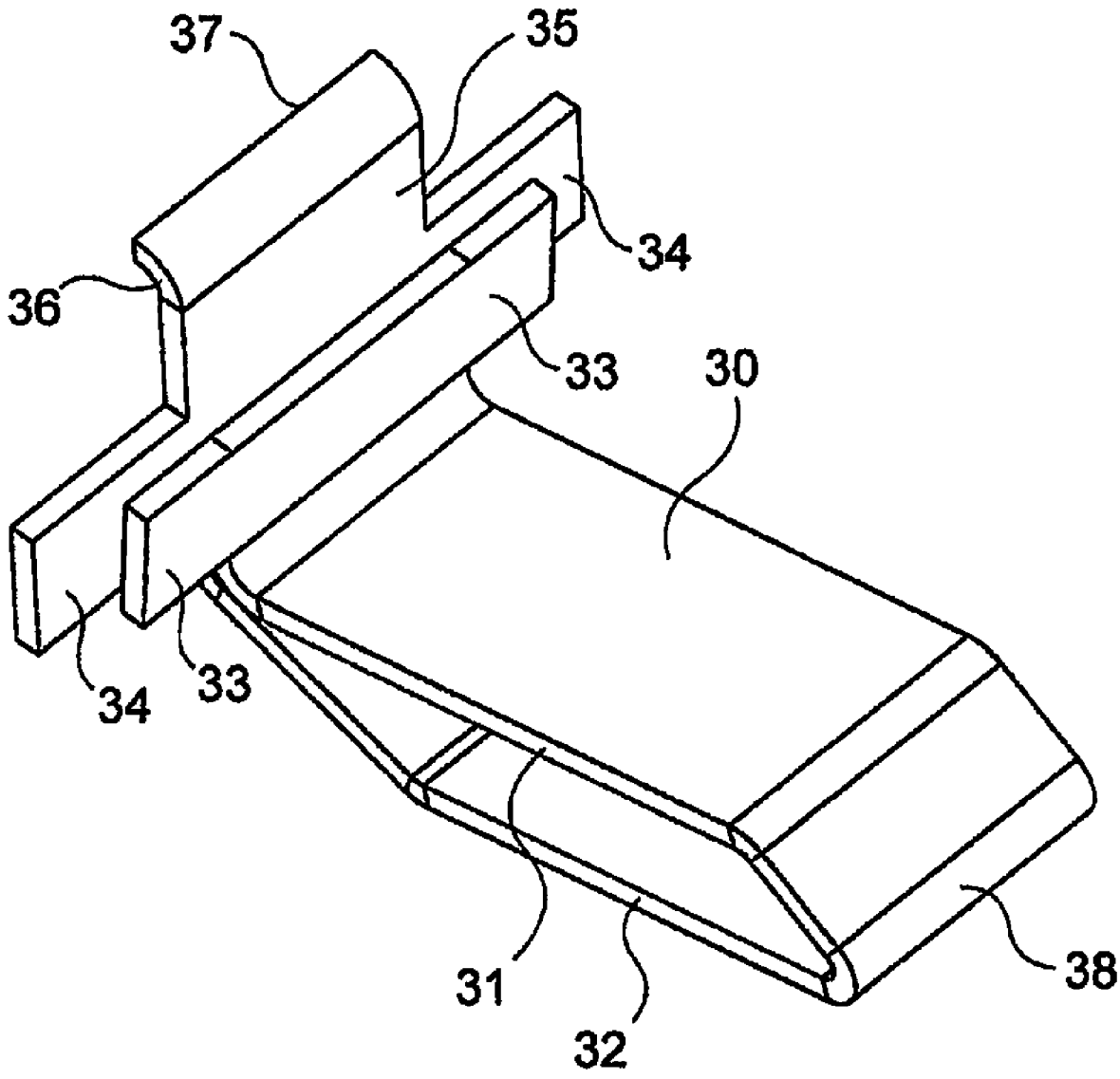
FIG. 4 is a perspective view of a locking element of the connector of FIG. 1.

As shown in FIG. 3, the lever 20 has a substantially U-shaped configuration. The lever 20 includes lateral wings 21. Each of the lateral wings 21 is configured to be mounted on a side of one of the arms 12 of the clamping portion 11 so as to be able to pivot about the clamping lug 10. Each of the wings 21 has a profile 23 substantially in the form of a portion of a circle. Each of the profiles 23 has at a center thereof a coaxial aperture 22 corresponding to the coaxial apertures 13 of the arms 12 to allow relative pivoting of the clamping lug 10 in relation to the lever 20 when a pivot is introduced into the coaxial apertures 13, 22. A projection 24 is provided on each of the wings 21 of the lever 20 at ends of the profiles 23. At least one of the wings 21 is provided with a notch 25. The lever 20 may be formed, for example, from a formed metal sheet, As shown in FIG. 4, the locking element 30 has locking arms 31, 32 formed substantially parallel to each other from, for example, a single metal sheet folded back on itself. At free ends of each of the locking arms 31, 32 are lateral extensions 33, 34, respectively. At least one of the locking arms 32 has at a free end a locking extension 35 which ends in a substantially right-angled fold 36 to form a support member 37. A contact member 38 is arranged at an end of the locking element 30 opposing the free ends of the locking arms 31, 32 and is configured to contact the terminal 2 of the battery 3.

Figure 5:
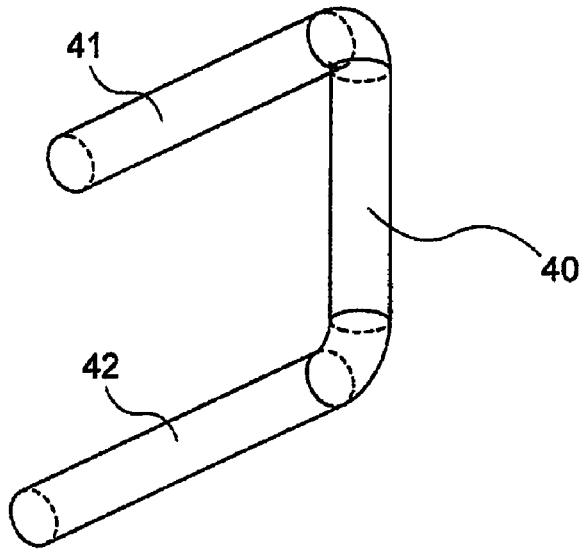
FIG. 5 is a perspective view of a clip of the connector of FIG. 1.

As shown in FIG. 5, the clip 40 has a substantially U-shape and has a first arm 41 and a second arm 42. The first arm 41 is slightly shorter than the second arm 42. The clip 40 may be formed, for example, from a formed metal wire.

During assembly, each of the lateral wings 21 of the lever 20 is positioned adjacent to an outside of one of the arms 12 of the clamping portion 11. The locking element 30 is arranged between the arms 12 of the clamping portion 11. The second arm 42 of the clip 40 is introduced into the coaxial holes 16*a*, 16*b* provided on the arms 12 of the clamping member 11. The first arm 41 of the clip 40 is introduced into the coaxial apertures 13, 22 of the clamping member 10 and the lever 20, respectively, and serves as a pivot for relative rotation of the lever 20 in relation to the clamping lug 10. The first arm 41 of the clip 40 passes through the locking element 30 between the locking arms 31, 32 thereof and thus helps to position it and to guide the deformation thereof when the connector 1 is fitted to the terminal 2 of the battery 3. The locking element 30 is mounted on the clamping member 11 between the arms 12 in such a way that the contact member 38 of the locking element 30 faces the clamping member 11 intended to receive the terminal 2 of the battery 3 and the support member 37 rests on the lateral extensions 15 provided on the ends of the arms 12.

Figure 6A:
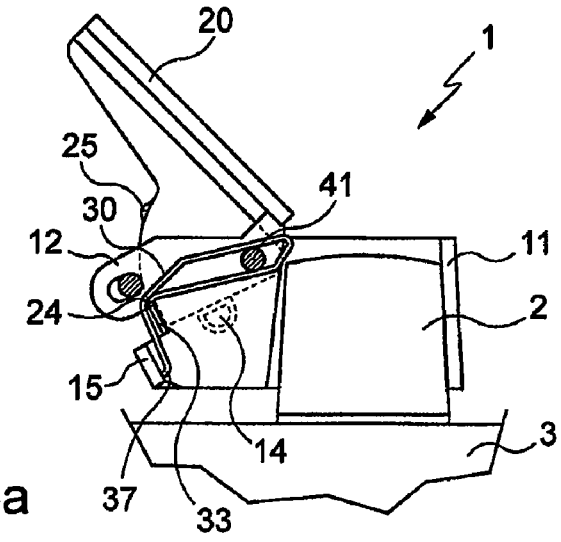
FIG. 6*a* is a schematic cross-section of a clamping member of the connector of FIG. 1 in a locked position.

FIGS. 1 and 6*a* show the connector 1 in a locked position. As shown in FIGS. 1 and 6*a*, the locking element 30 is arranged in such a way that, when the contact member 38 is not urged on contact with the terminal 2 of the battery 3, the lateral extensions 33 of the locking arm 31 of the locking element 30 are located on the path described by the projections 24 provided on the wings 21 of the lever 20 when the lever 20 pivots relative to the clamping lug 10 so as to be able to limit, by shape mating, rotation of the lever 20 to the locked position. Additionally, in the locked position, the cam grooves 14 are not urged by the lever 20 and the clamping member 11 is therefore not clamped. It is therefore not possible to clamp the clamping lug 10 to the terminal 2 in the locked position.

Figure 6B:
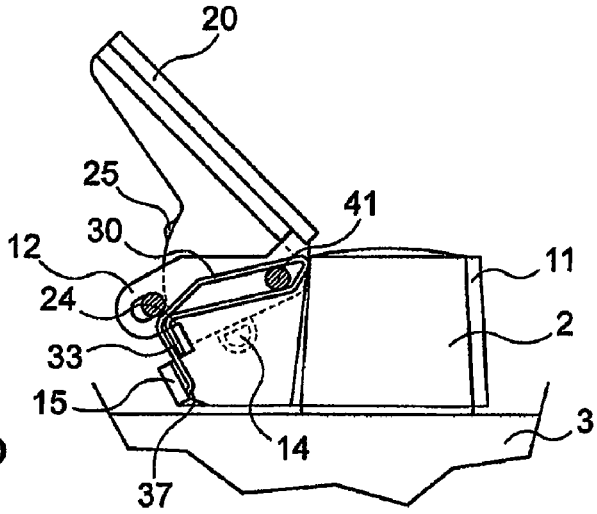
FIG. 6*b* is a schematic cross-section of a clamping member of the connector of FIG. 1 in an unlocked position.

FIG. 6*b* shows the connector 1 in an unlocked position. As shown in FIG. 6*b*, the locking element 30 is designed and positioned so as to undergo elastic deformation on contact with the terminal 2 of the battery 3 when the connector 1 is fitted thereto. As a result of the support member 37 resting on the extensions 15 of the arms 12, when the terminal 2 of the battery 3 contacts the contact member 38, the locking arms 31, 32 undergo elastic deformation in such a way that the lateral extensions 33 are located outside the path described by the projections 24 of the lever 20. Because the locking element 30 no longer mates with the lever 20, the lever 20 is allowed to pivot relative to the clamping lug 10. It is then possible to clamp the clamping lug 10 to the terminal 2.

Figure 6C:
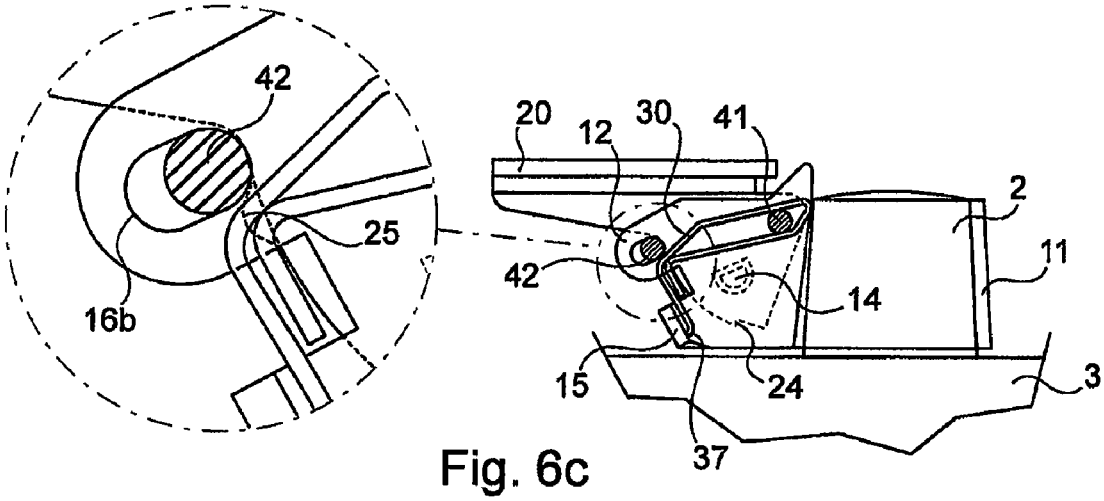
FIG. 6*c* is a schematic cross-section of a clamping member of the connector of FIG. 1 clamped to a terminal of a battery.

As shown in FIG. 6*c*, as the lever 20 pivots about the clamping member 11 toward the clamping position, the outer surface cam grooves 14 cooperate with inner surfaces of the wings 21 of the lever 20 to draw the arms 12 together thereby causing resilient clamping of the clamping member 11. As the arms 12 are drawn together, the arms 12 undergo elastic deformation and clamp the clamping member 11. As the lever 20 moves toward the clamping position, the second arm 42 of the clip 40 undergoes elastic deformation in order to pass around the notch 25 due to the presence of the hole 16*b*. The second arm 42 returns to its non-elastically deformed position once the lever 20 has reached the clamping position and cooperates with the notch 25 to secure the lever 20 in the clamped position by shape mating. The clamping lug 10 thus clamps the terminal 2 of the battery 3.

In the connector 1 according to the invention, the clamping lug 10 is clamped to the terminal 2 of the battery 3 only once the clamping lug 10 has been fitted to the terminal 2. This improves the secureness, since it is not possible to clamp the clamping lug 10 without having correctly fitted the clamping lug 10 to the terminal 2.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A connector for a terminal of a battery, comprising:

an elastically deformable clamping member that receives the terminal of the battery;

a lever moveable relative to the clamping member between a locked position and an unlocked position, the lever applying a clamping force to the clamping member in the unlocked position; and a locking element engaging the lever in the locked position to prevent movement thereof, the locking element being elastically deformable such that the locking element releases the lever when the clamping member receives the terminal of the battery so that the lever is moveable to the unlocked position.

2. The connector of claim 1, wherein the clamping member is substantially U shaped and includes a pair of arms that are elastically deformable toward each other, the lever drawing the arms toward each other in the locked position.

3. The connector of claim 2, wherein each of the arms has an outer surface cam groove that cooperates with the lever to draw the arms toward each other in the locked position.

4. The connector of claim 2, wherein the lever is substantially U-shaped and includes a pair of wings, each of the wings being arranged adjacent to one of the arms.

5. The connector of claim 4, further comprising a clip that passes through the wings and the arms to act as a pivot for the lever.

6. The connector of claim 5, wherein the clip includes a first arm and a second arm, the first arm acting as the pivot for the lever, the second arm engaging the lever in the unlocked position to secure the lever in the unlocked position.

7. The connector of claim 6, wherein the clip is elastically deformable.

8. The connector of claim 6, wherein the locking element is substantially U shaped and includes a pair of substantially parallel locking arms.

9. The connector of claim 8, wherein the locking element is arranged between the arms.

10. The connector of claim 9, wherein the first arm of the clip passes between the locking arms.

11. The connector of claim 1, wherein the locking element is substantially U shaped and includes a pair of substantially parallel locking arms, a support member that engages the clamping member is provided on a free end of at least one of the locking arms.

12. The connector of claim 11, wherein a contact member is arranged at an end of the locking element opposite from the support member, the contact member extending into the clamping member such that the contact member engages the terminal of the battery when the clamping member receives the terminal of the battery.

13. The connector of claim 12, wherein the locking element is arranged between the arms.

14. The connector of claim 1, further comprising a clip including a first arm and a second arm, the first arm acting as the pivot for the lever, the second arm engaging the lever in the unlocked position to secure the lever in the unlocked position.

* * * * *